US011362407B2

(12) United States Patent
Mei et al.

(10) Patent No.: US 11,362,407 B2
(45) Date of Patent: Jun. 14, 2022

(54) DIRECTIONAL COUPLERS WITH DC INSULATED INPUT AND OUTPUT PORTS

(71) Applicant: TTM TECHNOLOGIES, INC., St. Louis, MO (US)

(72) Inventors: Chong Mei, Jamesville, NY (US); Omar Eldaiki, East Syracuse, NY (US); Samir Tozin, East Syracuse, NY (US)

(73) Assignee: TTM Technologies Inc., St. Louis, MO (US)

( * ) Notice: Subject to any disclaimer, the term of this patent is extended or adjusted under 35 U.S.C. 154(b) by 74 days.

(21) Appl. No.: 16/805,519

(22) Filed: Feb. 28, 2020

(65) Prior Publication Data

US 2021/0273308 A1 Sep. 2, 2021

(51) Int. Cl.
*H01P 5/18* (2006.01)
*H01P 11/00* (2006.01)

(52) U.S. Cl.
CPC ..... *H01P 5/18* (2013.01); *H01P 11/001* (2013.01)

(58) Field of Classification Search
CPC ..... H01P 5/18–188; H01P 11/001
See application file for complete search history.

(56) References Cited

U.S. PATENT DOCUMENTS

| | | | | |
|---|---|---|---|---|
| 7,042,309 | B2 * | 5/2006 | Podell | H01P 5/187 333/112 |
| 7,190,240 | B2 * | 3/2007 | Podell | H01P 5/187 333/109 |
| 7,345,557 | B2 * | 3/2008 | Podell | H01P 5/185 333/109 |
| 9,653,771 | B2 * | 5/2017 | Ootsuka | H01P 5/187 |
| 9,905,901 | B1 * | 2/2018 | Lyu | H01P 5/187 |
| 10,084,225 | B2 * | 9/2018 | Ashida | H03H 7/185 |

* cited by examiner

*Primary Examiner* — Dean O Takaoka
*Assistant Examiner* — Alan Wong
(74) *Attorney, Agent, or Firm* — Polsinelli PC

(57) ABSTRACT

A directional coupler may include a first coupled section comprising a first and a second coupled transmission lines, the first coupled transmission line having a first end coupled to an input port. The directional coupler may also include a second coupled section comprising a first and a second coupled transmission lines. The directional coupler may also include a third coupled section comprising a first and a second coupled transmission lines. The first coupled transmission line of the third coupled section has a first end coupled to a second end of the second coupled transmission line of the second coupled section and a second end coupled to an output port. The directional coupler may further include a delay section. A total electrical length of the first coupled section, the second coupled section, the third coupled section, and the delay section is about 90 degrees.

22 Claims, 9 Drawing Sheets

DIRECTIONAL COUPLERS WITH DC INSULATED INPUT AND OUTPUT PORTS

FIELD

The disclosure is directed to directional couplers for power transmission applications. The directional couplers can be used for mobile 5G applications.

BACKGROUND

As one of the key mobile 5G technologies, massive multiple-input and multiple-output (MIMO) is being rapidly adopted in the recent deployments of wireless infrastructure. Massive MIMO uses an antenna array with a large number of antenna elements to transmit and receive signals. The number of antenna elements includes a number of transmitters and/or a number of receivers. Each antenna element is associated with a transmitting channel and/or a receiving channel where the magnitude and the phase of the signals are independently controlled. As mobile phone technologies evolve, the overall sizes of the transmitters and the receivers are becoming smaller. As such, size reduction and function integration are critical for designs even at a component level.

In transmitters, it is very common to use a directional coupler to sample the output of a power amplifier. The directional coupler samples the output power and feeds the power back to a pre-distortion circuitry for a linearization purpose. A DC blocking capacitor is often placed at the output of the directional coupler and prevents the DC bias of the power amplifier from flowing down to the next stage.

BRIEF SUMMARY

In an aspect, a directional coupler is provided. The directional coupler may include a first coupled section comprising a first and a second coupled transmission lines, the first coupled transmission line having a first end coupled to an input port. The directional coupler may also include a second coupled section comprising a first and a second coupled transmission lines. The first coupled transmission line of the second coupled section has a first end coupled to a second end of the first coupled transmission line of the first coupled section. The directional coupler may also include a third coupled section comprising a first and a second coupled transmission lines. The first coupled transmission line of the third coupled section has a first end coupled to a second end of the second coupled transmission line of the second coupled section and a second end coupled to an output port. The directional coupler may further include a delay section having a first end coupled to a second end of the second coupled transmission line of the first coupled section and a second end coupled to a first end of the second coupled transmission lines of the third coupled section. A total electrical length of the first coupled section, the second coupled section, the third coupled section, and the delay section is about 90 degrees.

In some aspect, a second end of the second coupled transmission line of the third coupled section is coupled to an isolated port.

In some aspect, a first end of the second coupled transmission line of the first coupled section is coupled to a coupled port.

In an aspect, a method is provided to form a directional coupler. The method may include forming a stack comprising a top ground layer comprising a first plurality of vias over the fourth layer. The stack may include a first layer comprising a first portion of a second coupled section, a delay section, and a first plurality of conductive pads under the top ground layer. The stack may also include a second layer comprising a second portion of the second coupled section and a second plurality of conductive pads under the first layer. The stack may also include a middle ground layer comprising a second plurality of vias under the second layer, a third layer comprising a first portion of first and third coupled sections and a third plurality of conductive pads under the middle ground layer, and a fourth layer comprising a second portion of the first and third coupled sections and a fourth plurality of conductive pads under the third layer, wherein one or more of the first and second pluralities of conductive pads of the second coupled section are coupled to one or more of the third and fourth pluralities of conductive pads through the second plurality of vias of the middle ground layer. The stack may further include a bottom ground layer comprising metal patches and a fifth plurality of conductive pads under the fourth layer, wherein the metal patches and the fifth plurality of conductive pads of the bottom ground layer are coupled to one or more of the first plurality of vias of the top ground layer through one or more of the second plurality of vias of the middle ground layer. The stack may also include a bottom layer comprising a plurality of mounting pads under the bottom ground layer, wherein the plurality of mounting pads are connected to one or more of the metal patches of the bottom ground layer. A total electrical length of the first coupled section, the second coupled section, the third coupled section, and the delay section is about 90 degrees.

Additional aspects and features are set forth in part in the description that follows, and in part will become apparent to those skilled in the art upon examination of the specification, or may be learned by the practice of the aspects discussed herein. A further understanding of the nature and advantages of certain aspects may be realized by reference to the remaining portions of the specification and the drawings, which forms a part of this disclosure.

BRIEF DESCRIPTION OF THE DRAWINGS

The description will be more fully understood with reference to the following figures and data graphs, which are presented as various aspects of the disclosure and should not be construed as a complete recitation of the scope of the disclosure, wherein.

DETAILED DESCRIPTION

The disclosure may be understood by reference to the following detailed description, taken in conjunction with the drawings as described below. It is noted that, for purposes of illustrative clarity, certain elements in various drawings may not be drawn to scale.

Figure 1:
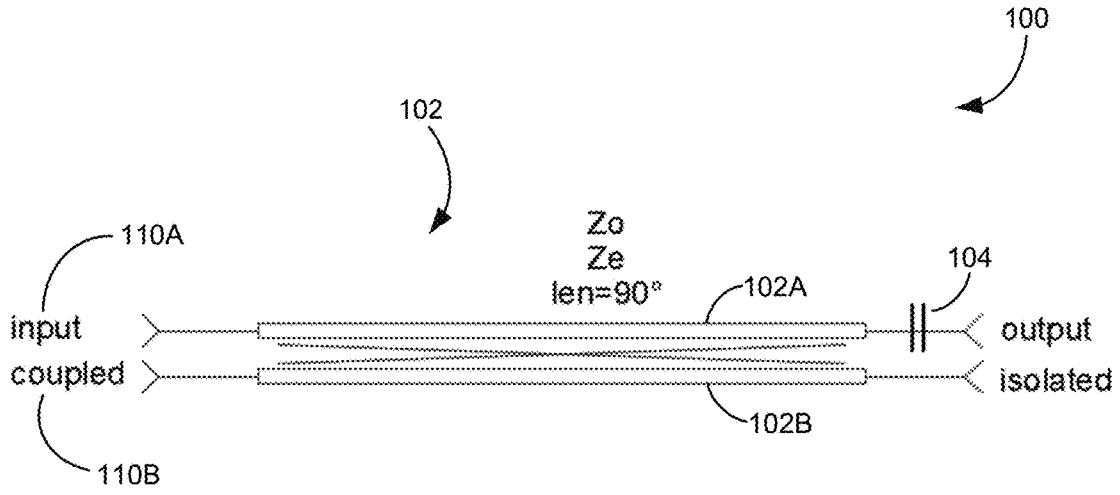
FIG. 1 (Prior Art)
FIG. 1 is a schematic illustrating a conventional directional coupler along with a DC blocking capacitor.

FIG. 1 is a schematic illustrating a conventional directional coupler along with a DC blocking capacitor. As shown, a system 100 includes a conventional coupler 102 and a DC blocking capacitor 104. The conventional coupler 102 has a first end connected to an input port 110A and a coupled port 110B on a second end of the coupler 102. The conventional coupler 102 also has a third end connected to an output port 110C through a DC blocking capacitor and a fourth end connected to an isolated port 110D. As shown in FIG. 1, the first end and the second end are on a first side of the coupler 102, while the third end and the fourth end are on an opposite second side to the first side. The DC blocking capacitor 104 provides DC insulation from the input port 110A to the output port 110C. The conventional coupler 100 uses two discrete components to achieve the DC insulation from the input port 110A to the output port 110B.

The disclosure provides a DC block directional coupler including DC insulation between an input port and an output port. The disclosed DC block directional coupler combines the functionality of the two discrete components, the DC blocking capacitor and the conventional directional coupler in one component, which saves space, and eliminates the issue with a minimum gap required between the two discrete components when mounting the two discrete components adjacent to each other. The directional coupler is used to couple a defined amount of electromagnetic power in a transmission line to a port enabling the signal to be used in another circuit. The disclosed DC blocking directional coupler can achieve both size reduction and cost saving.

Figure 2:
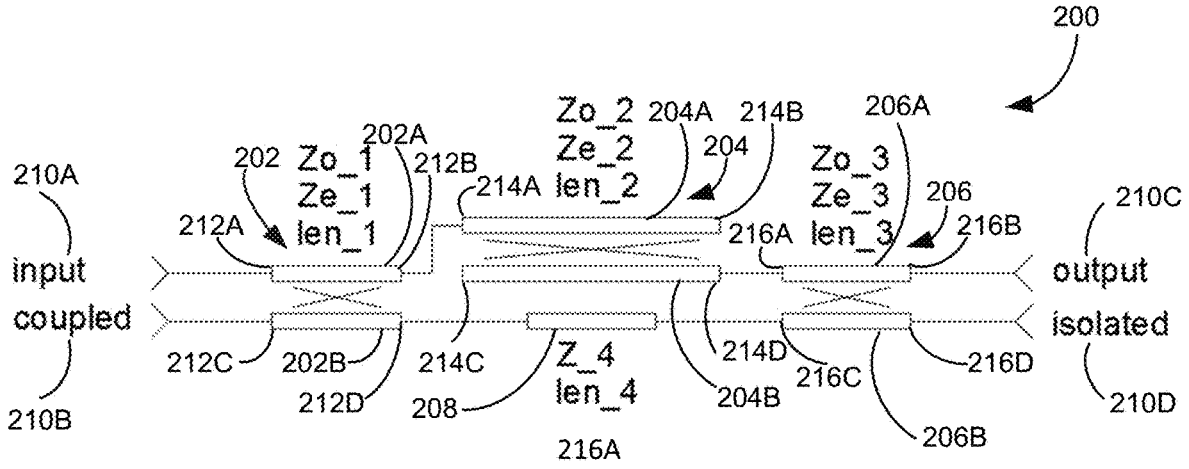
FIG. 2 is a schematic illustrating a directional coupler including three coupled sections and a delay section with a DC insulation between an input port and an output port in accordance with an aspect of the disclosure.

FIG. 2 is a schematic illustrating a directional coupler including three coupled sections and a delay section with a DC insulation between an input port and an output port in accordance with an aspect of the disclosure. As shown in FIG. 2, a DC blocking directional coupler 200 may include first, second and third coupled sections 202, 204, and 206, and a delay section 208. Each of the three coupled section includes a pair of coupled transmission lines, e.g. a first and a second transmission lines. The first coupled section 202 includes a first and second coupled transmission lines 202A-B. The second coupled section 204 includes a first and second coupled transmission lines 204A-B. The third coupled section 206 includes a first and second coupled transmission lines 206A-B.

Each of the first, second, and third coupled sections and the delay section is characterized by its even and odd mode impedances and electrical lengths. For example, the first coupled section has an odd impedance Zo1 and an even impedance Ze1 and an electrical length len1. The second coupled section has an odd impedance Zo2 and an even impedance Ze2 and an electrical length len2. The third coupled section has an odd impedance Zo3 and an even impedance Ze3 and an electrical length len3. The delay section includes a transmission line and has an electrical length len4 and a characteristic impedance Z4.

As shown in FIG. 2, the DC blocking directional coupler 200 connects to an input port 210A, a coupled port 210B, an output port 210C, and an isolated port 210D. The DC blocking directional coupler 200 couples an amount of the electromagnetic power or signals from the input port 210A to the coupled port 210B. The rest signal is coupled to the output port 210C, and nothing goes to the isolated port 210D.

In some variations, the isolated port 210D is terminated with a matched load (e.g. 50 ohms) and is not accessible to a user. DC blocking directional coupler couples power flowing in one direction. The power entering the output port 210C from the input port 210A only couples to the coupled port 210B but not the isolated port 210D. The power entering the input port 210A from the output port 2100 only couples to the isolated port 210D and is then terminated and is not coupled to the coupled port 210B.

In some variations, the DC blocking directional coupler includes four ports without internally terminating any port. The DC blocking directional coupler is bi-directional. For example, referring to FIG. 2 again, in a first direction when the signal is input from the input port, the power flows from the input port to the output port, the coupled port, but not to the isolated port. In a second direction when the signal could be input from the output port, the power could flow from the output port to the input port, the isolated port, but not to the coupled port.

Referring to FIG. 2 again, the input port 210A connects to the first end 212A of the first transmission line 202A of the first coupled section 202. The second end 212B of the first transmission line 202A of the first coupled section 202 connects to the first end 214A of the first transmission line 204A of the second coupled section 204. The second end 214B of the first transmission line 204A of the second coupled section 204 is left open. The first end 214C of the second transmission line 204B of the second coupled section 204 is also left open. The second end 214D of the second transmission line 204B of the second coupled section 204 connects to the first end 216A of the first transmission line 206A of the third coupled section 206. The second end 216B of the first transmission line 206A of the third coupled section 206 connects to output port 210C.

The coupled port 210B connects to the first end 212C of the second transmission line 202B of the first coupled section 202. The second end 212D of the second transmission line 202B of the first coupled section 202 connects to the first end 218A of the delay section 208. The second end 218B of the delay section 208 connects to the first end 216C of the second transmission line 206B of the third coupled section 206. The second end 216D of the second transmission line 206B of the third coupled section 206 connects to the isolated port 210D.

In this disclosure, the input port 210A and the output port 210C are DC insulated from each other. Also, the input port 210A and the output port 210C are DC insulated from the coupled port 210B and isolated port 210D.

By adjusting the even and odd mode impedances and electrical length of each coupled section, the DC blocking directional coupler can have the radio frequency (RF) performance very similar to the conventional directional coupler and yet has the DC insulation from the input port to the output port. Comparing with the schematics of the conventional coupler in FIG. 1, the DC blocking directional coupler 200 has a total electrical length, (i.e. the sum of the electrical lengths for the first, second and third coupled sections and the delay section) close to 90 degrees. With such a configuration, the input and output ports of the disclosed DC block directional coupler are DC isolated.

A coupling factor C is defined by Equation (1) as follows:

$$C=-10\log(P_{coupled}/P_{input})\text{dB} \quad \text{Equation (1)}$$

where $P_{input}$ is the input power at the input port 210A, and $P_{coupled}$ is the output power from the coupled port 210B.

The coupling factor represents the primary property of the directional coupler. The coupling factor is a negative quantity, it cannot exceed 0 dB for a passive device. Although a negative quantity, the minus sign is frequently dropped, but is still implied. The coupling factor is not a constant, but varies with frequency. While different designs may reduce the variance, a flat coupler is desirable.

The insertion loss L from the input port 210A to the output port 2100 is defined by Equation (2) as follows:

$$L=-10\log(P_{output}/P_{input})\text{dB} \quad \text{Equation (2)}$$

Part of this insertion loss is due to some power going to the coupled port 210B and is called coupling loss. The insertion loss of the directional coupler may include the coupling loss. The insertion loss may also include dielectric loss, conductor loss, among others.

Directivity D is directly related to isolation between the isolated port and the coupled port. The directivity D is defined by Equation (3) as follows:

$$D=-10\log P/P_{isolated}/P_{coupled}\text{ dB} \quad \text{Equation (3)}$$

where $P_{isolated}$ is the power output from the isolated port, and $P_{coupled}$ is the power output from the coupled port.

Return loss R is defined in Equation (4) as follows:

$$R=-10\log P_{reflected}/P_{input}\text{ dB} \quad \text{Equation (4)}$$

where $P_{input}$ is the input power at the input port 210A and $P_{reflected}$ is the reflected power at the input port 210A.

In some aspects, any of the first, second, third coupled sections of the DC blocking directional coupler can be implemented using different coupling structures, such as lumped element or multi-section coupled transmission lines, with equivalent even and odd mode impedances and electrical lengths.

In some aspects, one or more or any one of the first, second and third coupled sections may be replaced by a pair of inter-digitally connected coupled line groups. These inter-digitally connected coupled transmission lines offer an efficient way to achieve strong coupling in limited space and height profile.

Figure 3:
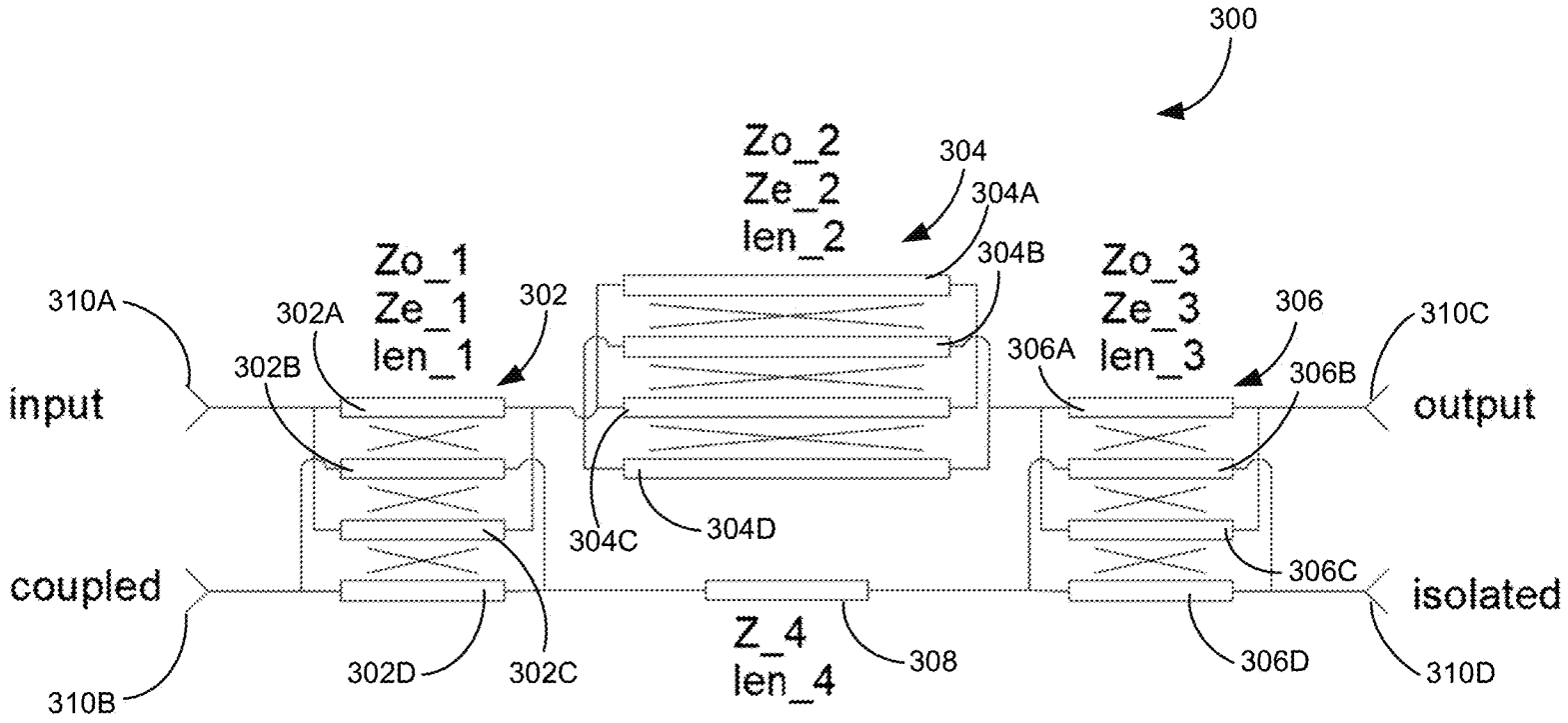
FIG. 3 is a schematic illustrating a DC blocking directional coupler including pairs of inter-digitally connected coupled line groups in accordance with aspects of the disclosure.

FIG. 3 illustrates a schematic of a DC block directional coupler including pairs of inter-digitally connected coupled line groups in accordance with aspects of the disclosure. As shown in FIG. 3, a DC blocking directional coupler 300 may include first, second, and third coupled sections 302, 304, and 306, and a delay section 308. Each of the first, second, and third coupled sections 302, 304, and 306 of the DC blocking directional coupler 300 includes a pair of inter-digitally connected coupled line groups. For example, the first coupled section 302 includes first, second, third, and fourth transmission lines 302A, 302B, 302C, and 302D. The first transmission line 302A is inter-digitally connected with the third transmission line 302C, which is coupled to the fourth transmission line 302D. The second transmission line 302B is inter-digitally connected with the fourth transmission line 302D, which is coupled to the third transmission line 302C. Likewise, the second coupled section 304 includes first, second, third, and fourth transmission lines 304A, 304B, 304C, and 304D. The first transmission line 304A is inter-digitally connected with the third transmission line 304C, which is coupled to the fourth transmission line 304D. The second transmission line 304B is inter-digitally connected with the fourth transmission line 304D, which is coupled to the third transmission line 304C. Similarly, the third coupled section 306 includes first, second, third, and fourth transmission lines 306A, 306B, 306C, and 306D. The first transmission line 306A is inter-digitally connected with the third transmission line 306C, which is coupled to the fourth transmission line 306D. The second transmission line 306B is inter-digitally connected with the fourth transmission line 306D, which is coupled to the third transmission line 306C.

In some variations, one or more of the first, second, or third coupled section may be replaced by a pair of inter-digitally connected coupled line groups.

Figure 4A:
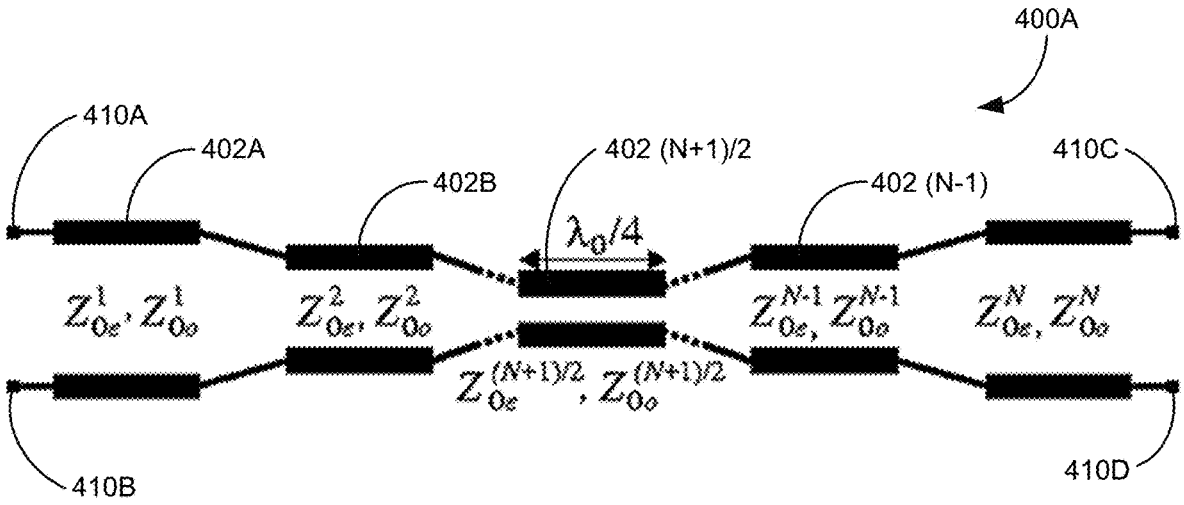
FIG. 4A illustrates a diagram of a multi-section directional coupler having a symmetric configuration in accordance with aspects of the disclosure.

Many types of multi-section couplers can achieve wide-band performance. FIG. 4A illustrates a diagram of a multi-section directional coupler having a symmetric configuration in accordance with aspects of the disclosure. As shown, a multi-section directional coupler 400A includes multi-sections 402A, 402B, 402C . . . 402(N+1)/2 . . . 402(N−1), and 402N. Each of the multi-sections includes a first and a second coupled transmission lines, and is characterized by an even characteristic impedance (e.g. $Z_{0e}^{1}$, $Z_{0e}^{2}$ . . . $Z_{0e}^{N-1}$, $Z_{0e}^{N}$) and an odd characteristic impedance (e.g. $Z_{0o}^{1}$, $Z_{0o}^{2}$ . . . . $Z_{0o}^{N-1}$, $Z_{0o}^{N}$).

The impedance of the first section is determined by Equation (4):

$$Z_0=(Z_{0e}*Z_{0o})^{0.5} \quad \text{Equation (4)}$$

The impedance of other sections can be determined in a similar way to the first section. When the impedance ratio of $Z_{0e}/Z_{0o}$ of the section increases, the coupling between the first and second coupled transmission lines increases.

The coupled sections are also characterized by the electrical length, which refers to the length of an electrical conductor in phase shift induced by transmission over the conductor at a frequency.

As shown in FIG. 4A, the first transmission lines of the multi-sections connect in series with each other. The second transmission lines of the multi-sections are also connected in series with each other. The middle section 402(N+1)/2 has a length of $\lambda_0/4$, where $\lambda_0$ is the wavelength of the RF wave. The multi-section coupler 400A is symmetric with respect to the middle section 402(N+1)/2. The first and second coupled transmission lines of the first section 402A connect to an input port 410A and a coupled port 410B, respectively. The first and second coupled transmission lines of the Nth section 402N connect to an output port 410C and an insulated port 410D, respectively. At least one of the multi-sections of the coupler 400A can be replaced by the DC blocking directional coupler, such as shown in FIG. 2 or FIG. 3.

Figure 4B:
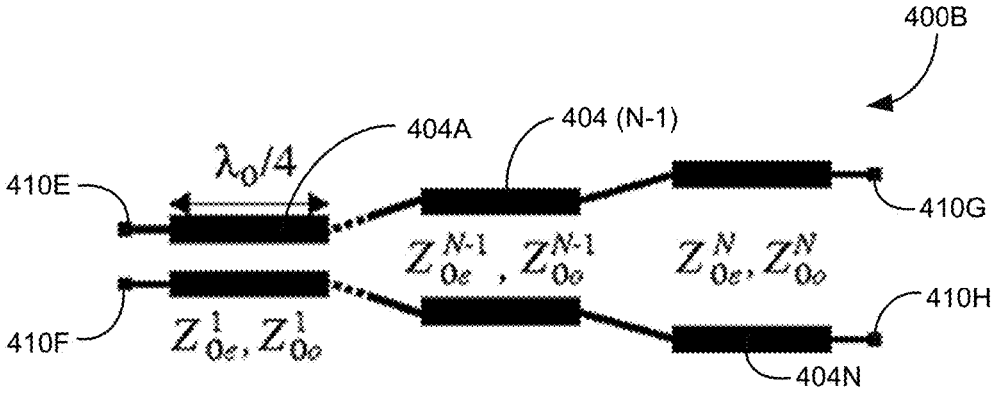
FIG. 4B illustrates a diagram of a multi-section directional coupler having an asymmetric configuration in accordance with aspects of the disclosure.

FIG. 4B illustrates a diagram of a multi-section directional coupler having an asymmetric configuration in accordance with aspects of the disclosure. As shown, a multi-section directional coupler 400B includes multi-sections 404A . . . 402(N−1), and 402N. Each of the sections includes a first and second coupled transmission lines, and is characterized by an even characteristic impedance (e.g. $Z_{0e}^{1}$, $Z_{0e}^{N-1}$, $Z_{0e}^{N}$) and an odd characteristic impedance (e.g. $Z_{0o}^{o1}$ . . . $Z_{0o}^{N-1}$, $Z_{0o}^{N}$). At least one of the multi-sections of the coupler 400B can be replaced by the DC blocking directional coupler, such as shown in FIG. 2 or FIG. 3.

As shown in FIG. 4B, the first transmission lines of the multi-sections connect in series with each other. The second transmission lines of the multi-sections are also connected in series with each other. The first section 404A has a length of $\lambda_0/4$, where $\lambda_0$ is the wavelength of the RF wave. The first and second coupled transmission lines of the first section 404A connect to an input port 410E and a coupled port 410F, respectively. The first and second coupled transmission lines of the Nth section 404N connect to an output port 410G and an insulated port 410H, respectively.

The disclosed DC blocking directional coupler can be used as a building block to replace one of the couplers in the multi-section structure, such as shown in FIG. 4A or FIG. 4B, to offer a DC insulated feature from the input port to the output port.

Figure 5:
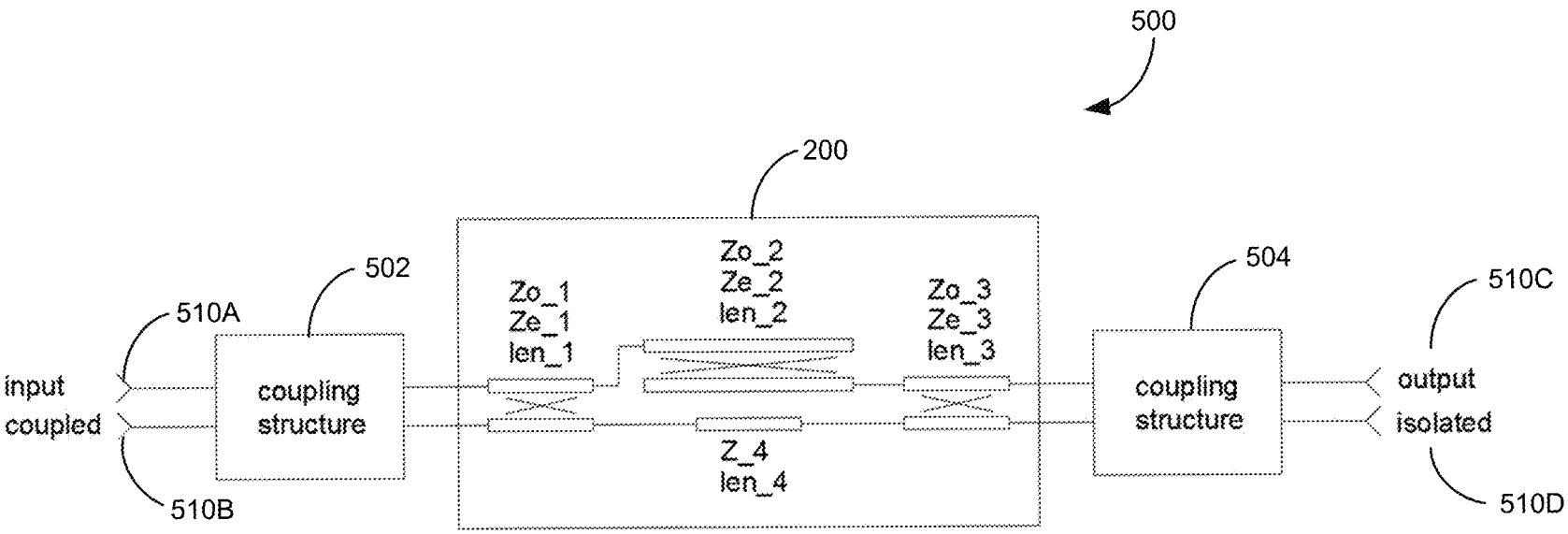
FIG. 5 shows a multi-section directional coupler with the DC block directional coupler of FIG. 2 inserted as a building block in accordance with aspects of the disclosure.

FIG. 5 shows a multi-section directional coupler including the DC blocking directional coupler of FIG. 2 as a building block in accordance with aspects of the disclosure. As shown, a multi-section directional coupler 500 may include a first coupling structure 502 having a first end coupled to input port 510A and coupled port 510B. The multi-section directional coupler 500 may also include a second coupling structure 504 having a second end coupled to an output port 510C and an isolated port 510D. The multi-section directional coupler 500 may also include the DC directional coupler 200 between a second end of the first coupling structure 502 and a first end of the second coupling structure 504. Each of the first and second coupling structures 502 and 504 may be one of the following including inter-digitally connected coupled line groups, lumped element network, or multi-section coupling structure, among others.

In some variations, the multi-section directional coupler may include the DC blocking directional coupled 300 to replace the directional coupler 200 as shown in FIG. 2.

Figure 6A:
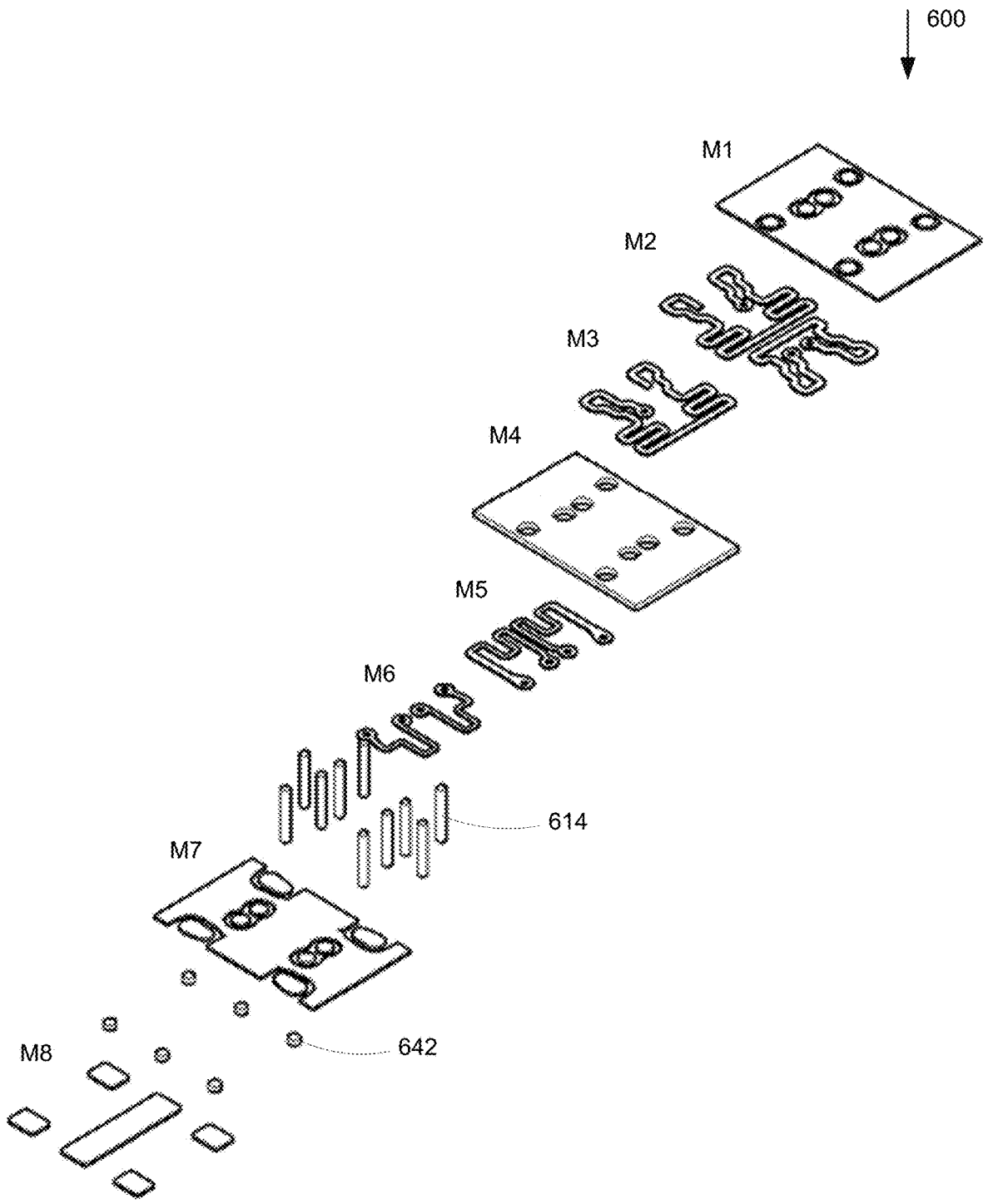
FIG. 6A is an exploded view of a DC blocking directional coupler prior to assembly in accordance with aspects of the disclosure.

FIG. 6A is an exploded view of a DC blocking directional coupler prior to assembly in accordance with aspects of the disclosure. As shown in FIG. 6A, the DC blocking directional coupler 600 includes eight metal layers M1 to M8 sequentially connected to each other. The DC blocking directional coupler 600 also includes plated through-holes (PTHs) 614 for connecting ground layers, i.e. Layer M1, Layer M4, and Layer M7, for internal electrical connections between Layers M2 and M3 and between Layers M5 and M6, and also for connecting to four signal ports, such as shown in FIG. 2. The DC blocking directional coupler 600 also includes plated blind vias (PBVs) 642 for connections between Layers M7 and M8. The PBVs are filled with a solid material. The DC blocking directional coupler 600 further includes dielectric layers between two neighboring metal layers (not shown in this exploded view).

Figure 6B:
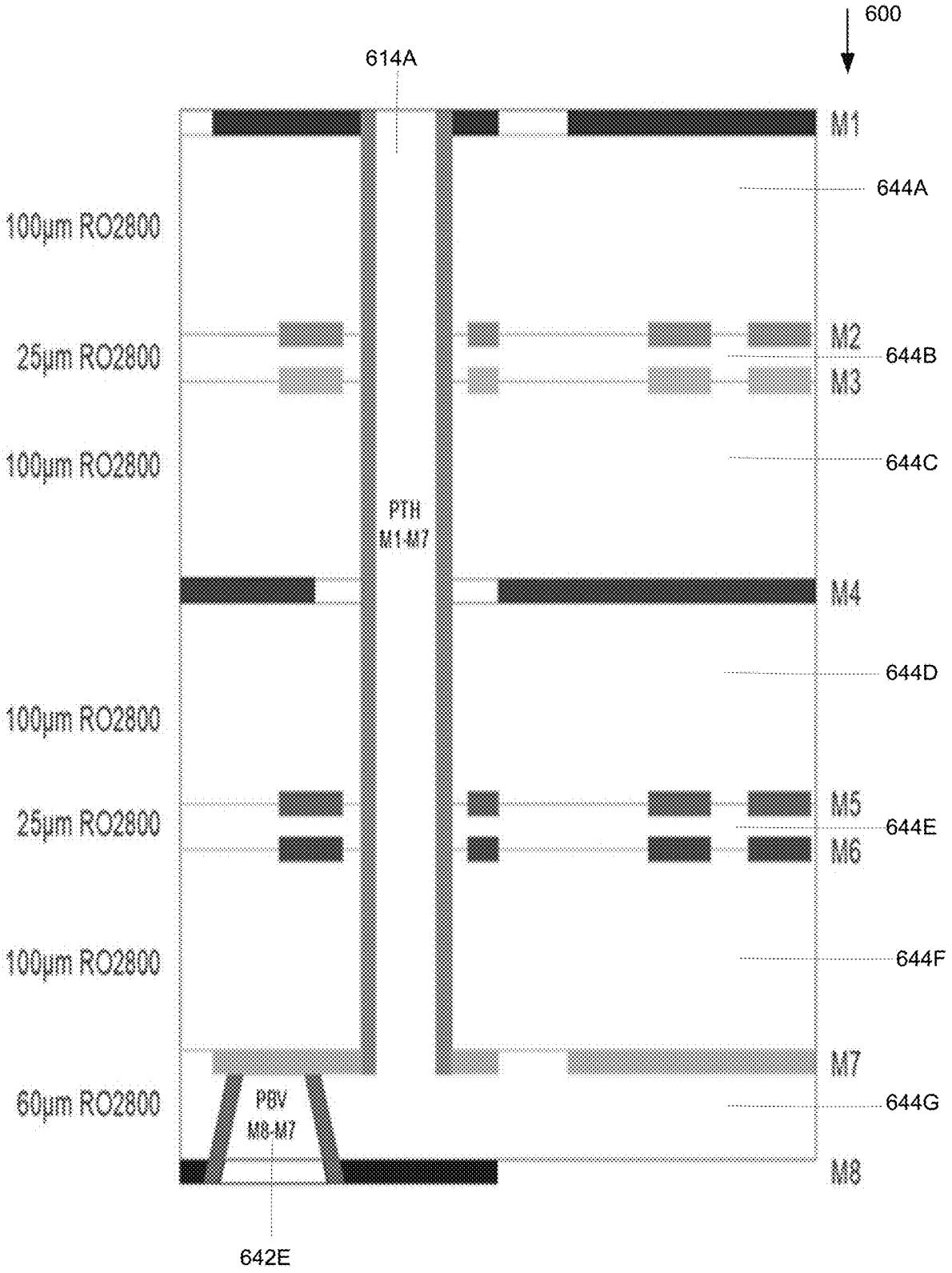
FIG. 6B is a cross-sectional view of the DC blocking directional coupler of FIG. 6A in accordance with aspects of the disclosure.

FIG. 6B is a cross-sectional view of the DC blocking directional coupler of FIG. 6A in accordance with aspects of the disclosure. As shown in FIG. 6B, seven dielectric layers 644A-G are placed between two neighboring metal layers, e.g. between M1 and M2, between M2 and M3, between M3 and M4, between M4 and M5, between M5 and M6, between M6 and M7, and between M7 and M8, respectively. PTH 614 connects the top ground layer M1 to the bottom ground layer M7. PBVs 642 connects the bottom ground layer M7 to the bottom layer M8. Note that the middle ground layer M4 is also connected to the top ground layer M1 and the bottom ground layer M7 (not shown in this view).

As an example, the dielectric layers 644A, 644C, 644D, and 644F, between M1 and M2, between M3 and M4, and also between M4 and M5, and between M6 and M7, respectively, may be about 100 μm thick. The dielectric layers 644B and 644E between M2 and M3 and between M5 and M6 may be thinner than the dielectric layer 644A between M1 and M2, for example, about 25 μm. The dielectric layer 644G between M7 and M8 may be about 60 μm thick. Each of metal layers M1, M2, M3, M4, M5, M6, M7, and M8 may be about 10 μm thick. The diameter of the PTH 614 or via and the PBV may be about 75 μm. It will be appreciated by those skilled in the art that these dimensions including thicknesses and diameters may vary.

Figure 6C:
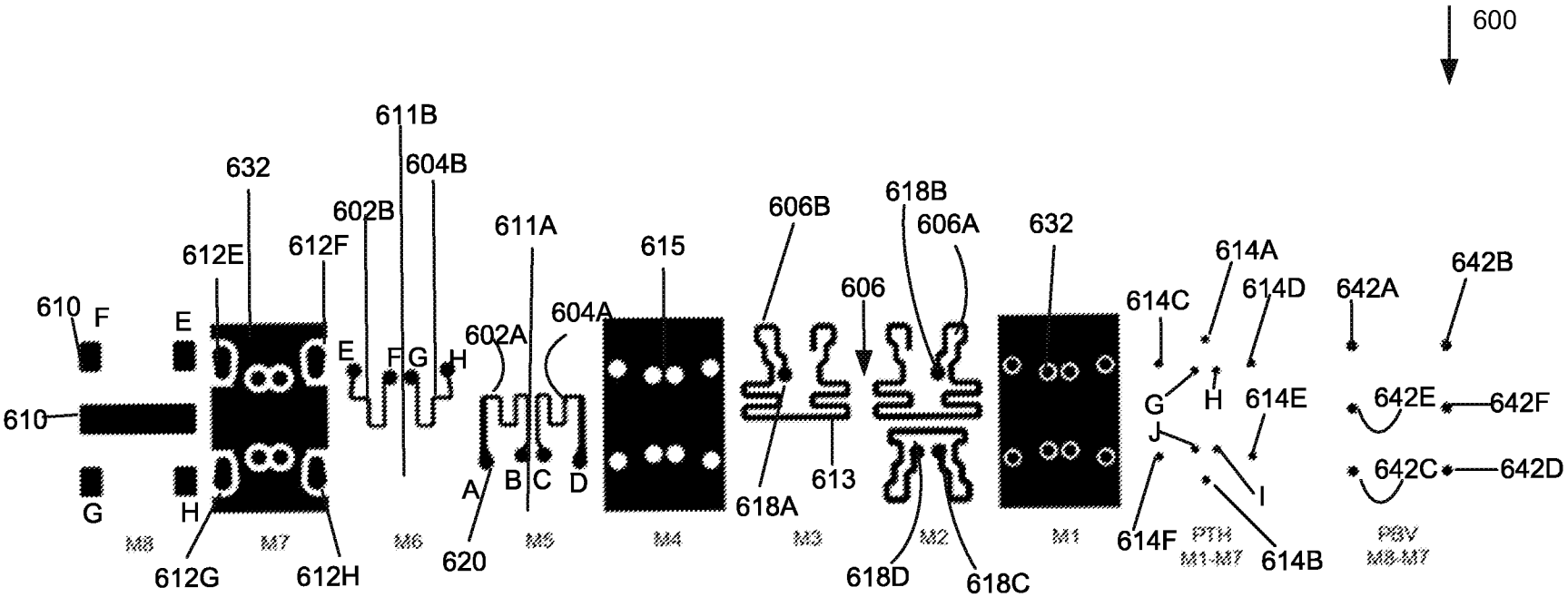
FIG. 6C is a top view of each of the metal layers of the DC blocking directional coupler of FIG. 6A in accordance with aspects of the disclosure.

FIG. 6C is a top view of each of the metal layers of the DC blocking directional coupler of FIG. 6A in accordance with aspects of the disclosure. Layer M1 is the top ground layer including a metal layer having a number of circular pads 632 arranged within the metal layer Ml. The vias 614A-H are isolated from each other.

As shown in FIG. 6C, a second coupled section 606 includes a first portion 606A in Layer M2 and a second portion 606B in Layer M3. Specifically, Layer M2 includes the first portion of the second coupled section 606 above a dashed line 613. Layer M2 further includes a delay section 608 below the dashed line 613. The delay section 608 is isolated from the first portion 606A of the second coupled section 606. Layer M2 also includes circular pads 618B-D, which are configured to connect to vias 614H and I-J, respectively, for internal signal connections.

Layer M3 includes a second portion 606B of the second coupled section 606. Layer M3 also includes circular pad 618A, which is configured to connect to via 614G for the internal signal connection.

Layer M4 is a middle ground layer including a metal layer and a number of holes 615, which are configured to align with the vias 614C-H, circular pads 632 in M1, metal patches 612E-H near the edges of M7 and circular pads 632 near the center of M7, when stacking Layers M1-M8 together.

Layer M5 includes a first portion 602A of a first coupled section 602 to the left side of a vertical dashed line 611A and a first portion 604A of the third coupled sections 604 to the right side of the vertical dashed line 611A. Layer M5 also includes circular pads 622A-D which are configured to align with vias 614E-F, and I-J.

Layer M6 includes a second portion 602B of the first coupled section 602 to the left side of a vertical dashed line 611B and a second portion 604B of the third coupled sections 604 to the right side of the vertical dashed line 611B. Layer M6 also includes four circular pads 622E-H which are configured to align with vias 614 C-D and G-H. In some aspects, these circular pads are conductive pads.

Layer M7 is the bottom ground layer including a metal layer. Layer M7 also includes metal patches 612E-H, which are isolated from each other layer. The metal patches 612E-H are configured to align with the four holes 615 near the edges of the middle ground layer M4 when stacking Layers M1-M8 together. Layer M7 also includes a number of circular pads 632 that are configured to align with the four vias 614 near the center of the middle ground layer or Layer M4.

Layer M8 is the bottom layer including mounting pads 610E-H configured to couple to the metal patches 612E-H in the bottom ground layer M7 through PBVs 642A-D. Layer M8 also includes a center mounting pad or strip 610. The mounting pads 610 and 610E-H are isolated from each other. The four mounting pads 610E-H arranged at the four corners of M8 are electrical signal pads for four ports, including the input port, the output port, the coupled port, and the isolated port, such as those shown in FIG. 2. The center mounting pad or strip 610 on M8 is the ground pad which is configured to connect to M7 through the middle PBVs 642E-F. The mounting pads 610E-G and the center mounting strip 610 are formed of a conductive material.

As shown in FIG. 6C, the first and third coupling sections 604 and 602 are implemented on Layers M5 and M6. The pads of Layer M6 is connected to the pads of the second coupled section 606A-B on Layers M2 and M3 and the pads of the delay section 608 on M2 through the vias in the center portion of Layer M4. Layers M2 and M3 including the second coupled section 606 including the first and second portions 606A-B are positioned in the middle to tune the center frequency of the DC blocking directional coupler 600.

Layers M1, M4, and M7 are the ground references for the first, second, and third coupled sections, and the delay section, which are connected together through the vias 614A-B to the center mounting strip 610 on Layer M8.

The metal patches 612E-H in Layer M7 are used as signal pads and are connected to the mounting pads 610E-H on M8. The four circular pads 632 are used to connect for internal connections to the first, second, third coupling sections and the delay section.

In some aspects, the delay section may include parallel lines, such as shown in FIG. 6A. In some aspects, the delay section may include a single line (no shown).

An implementation of using the schematic shown in FIG. 2 can form a surface mount directional coupler having an area efficient size, e.g. 2 mm by 1.25 mm, which can be realized by using the layout as shown in FIGS. 6A-C.

The top ground layer or Layer M1 in FIGS. 6A-C had a length L of 2 mm by a width W of 1.25 mm. The stack of the coupler had a total thickness of about 0.55 mm.

The DC blocking directional coupler provides function integration, size reduction, and cost reduction. The input port and output port are DC insulated by the DC blocking directional coupler.

In some variations, the coupling region can be interdigitally connected coupled line groups. In some variations, the coupling region can be an equivalent lumped element network. In some variations, the coupling region can be an equivalent multi-section coupling structure. In some variations, the directional coupler with DC insulated input/output port can be used as a building block for other wideband multi-section couplers.

In some variations, the total electrical length may range from 80 degrees to 100 degrees. In some variations, the total electrical length is equal to or greater than 80 degrees. In some variations, the total electrical length is equal to or greater than 85 degrees. In some variations, the total electrical length is equal to or greater than 90 degrees. In some variations, the total electrical length is equal to or greater than 95 degrees. In some variations, the total electrical length is equal to or less than 100 degrees. In some variations, the total electrical length is equal to or less than 95 degrees. In some variations, the total electrical length is equal to or less than 90 degrees. In some variations, the total electrical length is equal to or less than 85 degrees.

In some variations, the directional coupler has a return loss of at least 15 dB. In some variations, the directional coupler has a return loss equal to or greater than 20 dB. In some variations, the directional coupler has a return loss equal to or greater than 25 dB. In some variations, the directional coupler has a return loss equal to or greater than 30 dB.

In some variations, the directional coupler has a directivity of at least 15 dB. In some variations, the directional coupler has a directivity equal to or greater than 20 dB. In some variations, the directional coupler has a directivity equal to or greater than 25 dB. In some variations, the directional coupler has a directivity equal to or greater than 30 dB.

Example 1

As an example, a 20 dB directional coupler was achieved with even-mode characteristic impedances Ze1, Ze2, and Ze3 for the respective first, second and third coupled sections to be 122 Ohm and odd-mode characteristic impedances Zo1, Zo2, and Zo3 for the respective first, second and third coupled sections to be 19.3 Ohm. The electrical lengths 1 and 3 for the respective first and third coupled sections were both equal to 3.84 degrees at 2 GHz, the electrical length 2 for the second coupled section was equal to 80.16 degrees at 2 GHz, and the electrical length 4 for the delay section was zero degree. Note that the electrical length of the second coupled section was significantly higher than the electrical lengths of the first and third coupled sections.

Figure 7:
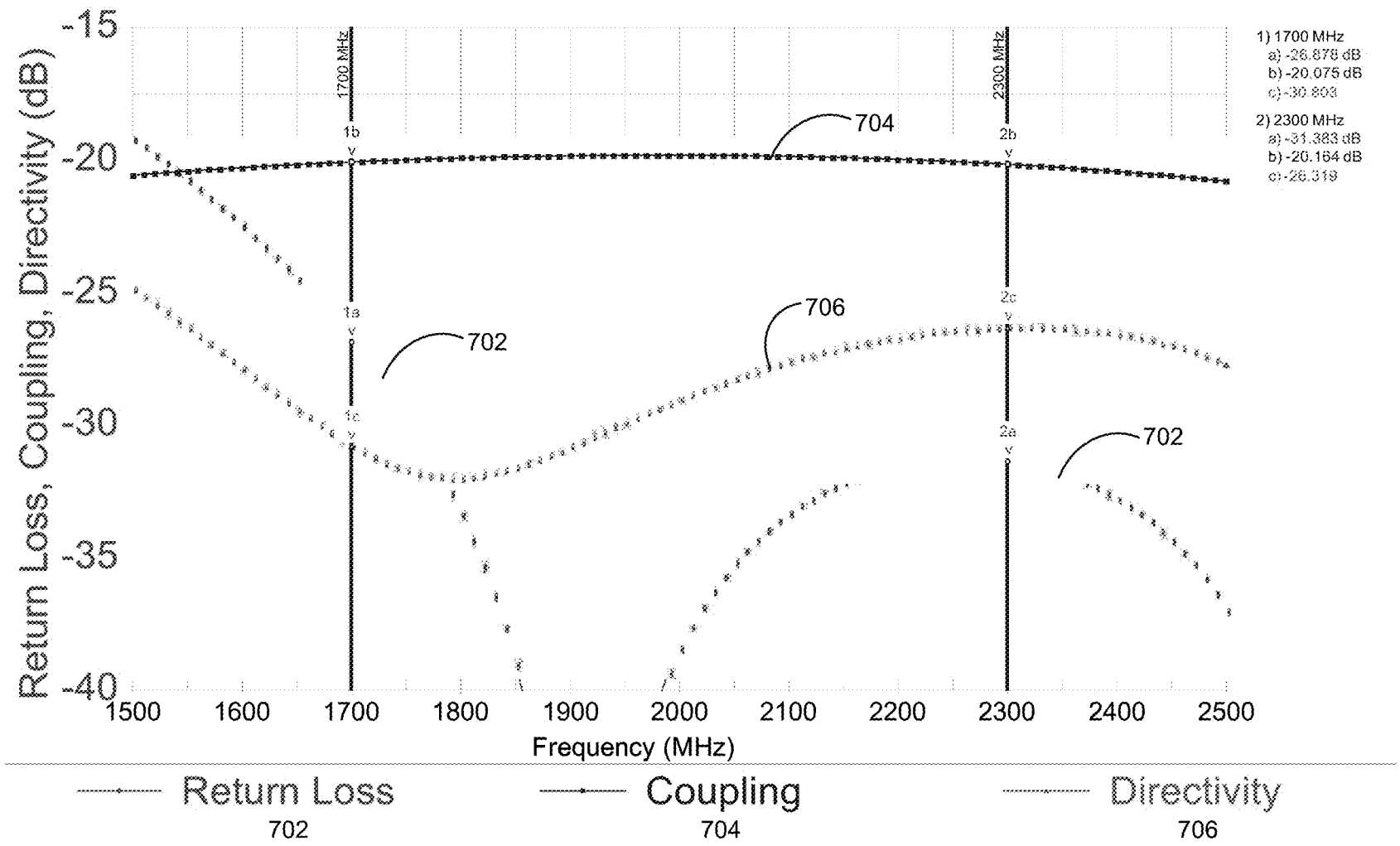
FIG. 7 shows the electrical performance of the DC blocking directional coupler in accordance with a first aspect of the disclosure.

FIG. 7 shows the electrical performance of the DC blocking directional coupler in accordance with a first aspect of the disclosure. The electrical performance of the coupler included coupling represented by curve 704, return loss represented by curve 702, and directivity represented by curve 706. As shown by curve 704, the coupling in the frequency band of 600 MHz from 1700 MHz to 2300 MHz was nearly flat at 20 dB. Also, as shown by curve 702, the directional coupler had better than 25 dB return loss. Further, the directional coupler had better than 25 dB directivity, as shown by curve 706.

The total electrical length of 90 degrees makes the coupling peak at the frequency band center of FIG. 7, so that the flatness of the coupling can be optimized for the entire frequency band. If the flatness is not required, the total electrical length can increase or decrease.

If the design target frequency changes, the physical length of all the lines would change correspondingly. However, the electrical length that is evaluated at new center frequency would remain the same, and also all the even odd mode impedances remain the same. For example, when the target frequency or target band center frequency changes from 2 GHz to 3 GHz, the electrical length of 90 degree at 2 GHz line becomes 90 degree at 3 GHz line, but the physical length becomes shorter. If the performance plot x axis of FIG. 7 is renormalized to the center frequency, the curves would be the same for all frequencies.

In this example, the even and odd mode impedances of all three coupled sections were chosen to be the same, which allowed the directional coupler to be easily packaged in the same material stack-up. Also, the directional coupler was bi-directional, because the first and third coupled sections were identical.

Example 1 applied to the schematics in both FIG. 2 and FIG. 3.

Example 2

For the DC blocking directional coupler, a reduced electrical length would reduce the insertion loss on the path from the input port to the output port, because the insertion loss is generally proportional to the electrical length.

In this example, the total electrical length of the three coupled sections was shortened to reduce the electrical length of the path from the input port to the output port, when the even and odd mode impedances of the coupling sections were different.

The electrical length 4 of the delay section was adjusted to make up the total electrical length to meet the requirement of 90 degrees of the total electrical length to ensure the DC insulation for the DC blocking directional coupler.

In this example, even impedances Ze1 and Ze3 for the first and third coupled sections were equal to 131 Ohm, even impedance Ze2 for the second coupled section was equal to 144 Ohm. Also, odd impedances Zo1 and Zo3 for the first and third coupled sections were equal to 19.1 Ohm, odd impedance Zo2 for the second coupled section was equal to 10 Ohm. Also, impedance Z4 for the delay section was equal to 50 Ohm. The electrical lengths 1 and 3 for the first and third coupled sections were equal to 3.6 degrees at 2 GHz, the electrical length 2 for the second coupled section was equal to 40.8 degrees at 2 GHz, and the electrical length 4 for the delay section was equal to 42 degrees at 2 GHz. The electrical length of the second coupled section was significantly higher than the electrical lengths of the first and third coupled sections.

Note that the electrical length of the second coupled section of 40.8 degrees was shorter than Example 1 where the electrical length of the second coupled section was equal to 80.16 degrees at 2 GHz. The total electric length for the path from the input port to the output port, including electrical lengths 1, 2, and 3, was 48 degrees. Also, the electrical length 4 for the delay section was chosen to be 42 degrees at 2 GHz, such that the total electric length for the DC directional coupler including the first, second and third coupled sections and the delay section, i.e. including electrical lengths 1, 2, 3 and 4, was 90 degrees, which provided the DC insulation from the input port to the output port.

Figure 8:
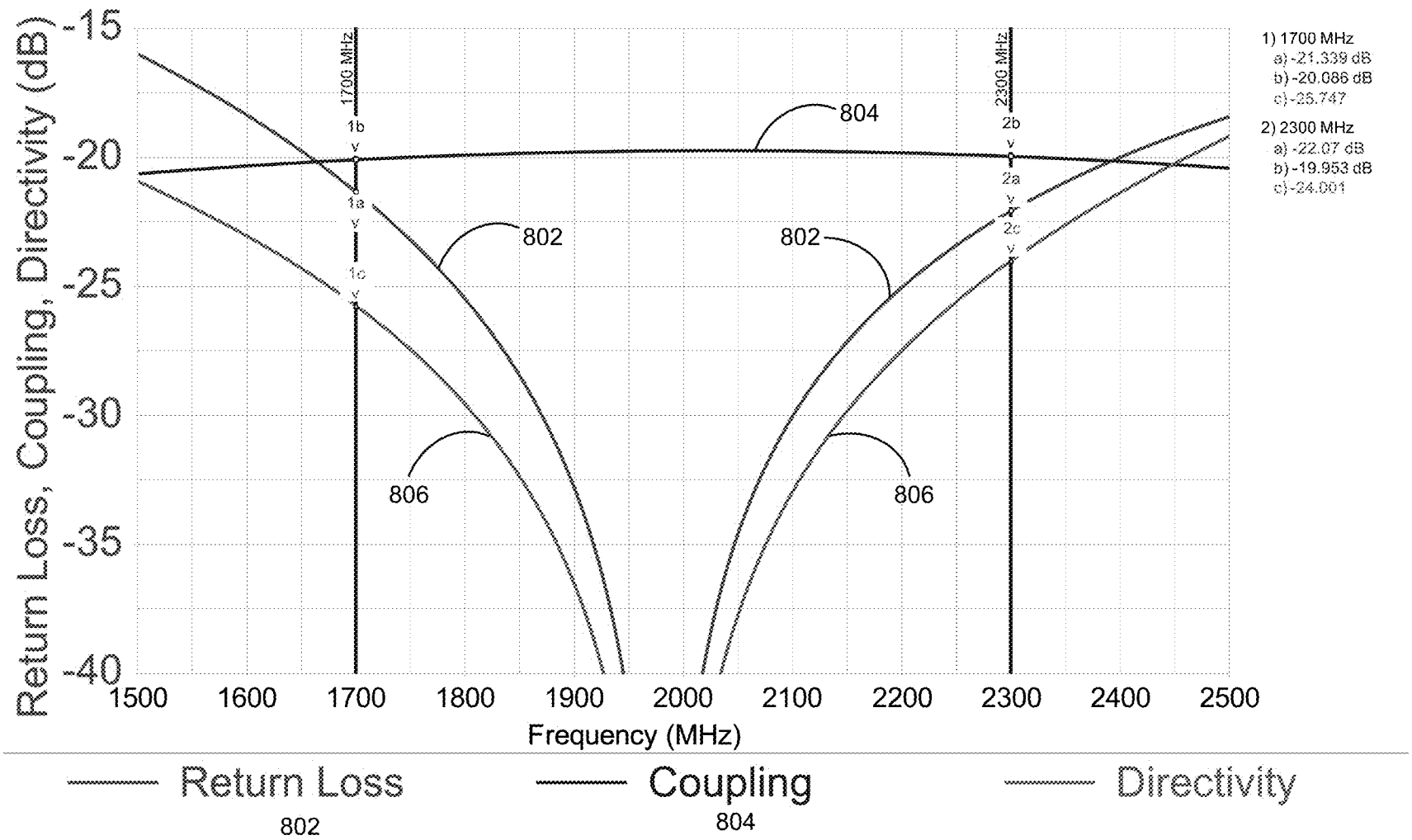
FIG. 8 shows the electrical performance of the DC blocking directional coupler in accordance with a second aspect of the disclosure.

FIG. 8 shows the electrical performance of the DC blocking directional coupler in accordance with a second aspect of the disclosure. The electrical performance of the coupler included coupling represented by curve 804, return loss represented by curve 802, and directivity represented by curve 806. As shown by curve 804, the coupler had a 20 dB flat coupling in the frequency band of 600 MHz from 1700 MHz to 2300 MHz. As shown by curve 802, the coupler had a return loss better than 20 dB. As shown by curve 806, the coupler had a directivity better than 20 dB.

Again, the total electrical length of 90 degrees makes the coupling peak at the frequency band center of FIG. 8, so that the flatness of the coupling can be optimized for the entire frequency band. If the flatness is not required, the total electrical length can increase or decrease.

Again, if the design target frequency changes, the physical length of all the lines would change correspondingly. However, the electrical length that is evaluated at new center frequency would remain the same, and also all the even odd mode impedances remain the same. For example, when the target frequency or target band center frequency changes from 2 GHz to 3 GHz, the electrical length of 90 degree at 2 GHz line becomes 90 degree at 3 GHz line, but the physical length becomes shorter. If the performance plot x axis of FIG. 8 is renormalized to the center frequency, the curves would be the same for all frequencies.

The DC blocking directional coupler may require strong coupling in all three coupled sections. Particularly, a shorten path from the input port to the output port may require stronger coupling in the second coupled section than the first and third coupled sections.

Example 2 also applied to the schematics in both FIG. 2 and FIG. 3.

Having described several aspects, it will be recognized by those skilled in the art that various modifications, alternative constructions, and equivalents may be used without departing from the spirit of the disclosure. Additionally, a number of well-known processes and elements have not been described in order to avoid unnecessarily obscuring the aspects disclosed herein. Accordingly, the above description should not be taken as limiting the scope of the document.

Those skilled in the art will appreciate that the presently disclosed aspects teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the method and system, which, as a matter of language, might be said to fall there between.

What is claimed is:

1. A directional coupler comprises:

a first coupled section comprising a first and a second coupled transmission lines, the first coupled transmission line having a first end coupled to an input port;

a second coupled section comprising a first and a second coupled transmission lines, the first coupled transmission line of the second coupled section having a first end coupled to a second end of the first coupled transmission line of the first coupled section;

a third coupled section comprising a first and a second coupled transmission lines, the first coupled transmission line of the third coupled section having a first end coupled to a second end of the second coupled transmission line of the second coupled section and a second end coupled to an output port; and a delay section having a first end coupled to a second end of the second coupled transmission line of the first coupled section and a second end coupled to a first end of the second coupled transmission lines of the third coupled section, wherein a total electrical length of the first coupled section, the second coupled section, the third coupled section, and the delay section is about 90 degrees.

2. The directional coupler of claim 1, wherein a second end of the second coupled transmission line of the third coupled section is coupled to an isolated port.

3. The directional coupler of claim 1, wherein a first end of the second coupled transmission line of the first coupled section is coupled to a coupled port.

4. The directional coupler of claim 1, wherein the second coupled transmission line of the second coupled section has a first open end.

5. The directional coupler of claim 1, wherein the first coupled transmission line of the second coupled section has a second open end.

6. The directional coupler of claim 1, wherein the total electrical length ranges from 80 degrees to 100 degrees.

7. The directional coupler of claim 1, wherein the first coupled section and the third coupled section are identical.

8. The directional coupler of claim 7, wherein the third coupled section has the same even and odd impedances and the same electrical length as the first coupled section.

9. The directional coupler of claim 7, wherein the directional coupler is bi-directional.

10. The directional coupler of claim 7, wherein the directional coupler has a flat coupling at a frequency band center.

11. The directional coupler of claim 1, wherein the first coupled section, the second coupled section, and the third coupled section are identical.

12. The directional coupler of claim 11, wherein the delay section has an electrical length of zero degrees.

13. The directional coupler of claim 11, wherein the second and third coupled sections have the same even and odd impedances and the same electrical length as the first coupled section.

14. The directional coupler of claim 11, wherein the directional coupler has a return loss of at least 15 dB and a directivity of at least 15 dB.

15. The directional coupler of claim 1, wherein the first coupled transmission line of one or more of the first coupled section, the second coupled section, or the third coupled section comprises a first pair of inter-digitally connected coupled lines.

16. The directional coupler of claim 1, wherein the second coupled transmission line of one or more of the first coupled section, the second coupled section, or the third coupled section comprises a second pair of inter-digitally connected coupled lines.

17. The directional coupler of claim 1, wherein the first coupled transmission line of one or more of the first coupled section, the second coupled section, or the third coupled section comprises equivalent lump elements.

18. The directional coupler of claim 1, wherein the second coupled transmission line of one or more of the first coupled section, the second coupled section, or the third coupled section comprises equivalent lump elements.

19. A multi-section coupler comprises a first coupling structure between the directional coupler of claim 1 and the input port.

20. The multi-section coupler of claim 19, further comprising a second coupling structure between the directional coupler and the output port.

21. A directional coupler comprising:

a top ground layer serving as a first ground reference and comprising a first plurality of conductive pads;

a first layer comprising a first portion of a first coupled section, a delay section, and a second plurality of conductive pads under the top ground layer;

a second layer comprising a second portion of the first coupled section and a third plurality of conductive pads under the first layer;

a middle ground layer serving as a second ground reference under the second layer;

a third layer comprising a first portion of second and third coupled sections and a fourth plurality of conductive pads under the middle ground layer;

a fourth layer comprising a second portion of the second and third coupled sections, and a fifth plurality of conductive pads under the third layer;

a bottom ground layer serving as a third ground reference and comprising a plurality of metal patches and a sixth plurality of conductive pads under the fourth layer, wherein a first plurality of vias connects the bottom ground layer to the top ground layer through the middle ground layer, and a second plurality of vias connects the plurality of metal patches and the sixth plurality of conductive pads with the first plurality, second plurality, third plurality, fourth plurality, and fifth plurality of conductive pads from the bottom ground layer to the top ground layer through the first, second, third and fourth layers and the middle ground layer; and wherein a total electrical length of the first coupled section, the second coupled section, the third coupled section, and the delay section is about 90 degrees.

22. The directional coupler of claim 21, further comprising a bottom layer comprising a plurality of mounting pads under the bottom ground layer, wherein the plurality of mounting pads are connected to one or more of the metal patches of the bottom ground layer, wherein the plurality of mounting pads are coupled to one or more of the metal patches of the bottom ground layer by one or more of a plurality of blind vias.

* * * * *